US008090286B2

(12) United States Patent
Ino et al.

(10) Patent No.: US 8,090,286 B2
(45) Date of Patent: Jan. 3, 2012

(54) IMAGE FORMING APPARATUS AND TONER SUPPLY CONTAINER USED THEREFOR

(75) Inventors: Toshiaki Ino, Soraku-gun (JP); Shinya Mimura, Nara (JP); Yasuhiro Nishimura, Takaishi (JP); Masahiro Seki, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 512 days.

(21) Appl. No.: 12/259,520

(22) Filed: Oct. 28, 2008

(65) Prior Publication Data

US 2009/0116864 A1 May 7, 2009

(30) Foreign Application Priority Data

Nov. 7, 2007 (JP) ..... 2007-289115

(51) Int. Cl.
*G03G 21/20* (2006.01)

(52) U.S. Cl. ..... 399/92; 399/93

(58) Field of Classification Search ..... 399/92, 399/93

See application file for complete search history.

(56) References Cited

U.S. PATENT DOCUMENTS

| | | | | |
|---|---|---|---|---|
| 4,666,282 | A * | 5/1987 | Rowe | 399/93 |
| 5,371,577 | A * | 12/1994 | Fujimura et al. | 399/93 |
| 5,532,798 | A | 7/1996 | Nakagami et al. | |
| 6,813,457 | B2 | 11/2004 | Yoshiki | |
| 7,440,717 | B2 | 10/2008 | Kubota et al. | |
| 2001/0021326 | A1 | 9/2001 | Yanagisawa et al. | |
| 2003/0123898 | A1 | 7/2003 | Yoshiki | |
| 2006/0024083 | A1 * | 2/2006 | Hori et al. | 399/93 |
| 2008/0038008 | A1 | 2/2008 | Fujita et al. | |

FOREIGN PATENT DOCUMENTS

| | | | |
|---|---|---|---|
| CN | 1900837 | A | 1/2007 |
| JP | 7-43990 | A | 2/1995 |
| JP | 8-220952 | A | 8/1996 |
| JP | 2001-109263 | A | 4/2001 |
| JP | 2003-177604 | A | 6/2003 |
| JP | 2006-284878 | A | 10/2006 |
| JP | 2007-078848 | A | 3/2007 |
| JP | 2007-232949 | A | 9/2007 |

* cited by examiner

*Primary Examiner* — David Gray
*Assistant Examiner* — Barnabas Fekete
(74) *Attorney, Agent, or Firm* — Nixon & Vanderhye P.C.

(57) ABSTRACT

In a toner supply container, an air blowing mechanism includes an air blowing fan, an air blowing tube, and an air inlet coupling member. The air inlet coupling member is in close contact with a side wall of the toner container around an air inlet, and includes a skirt made of elastic silicone rubber that covers a joint part of the air blowing tube and the air inlet. An exhaust mechanism includes an exhaust outlet coupling member, an exhaust tube, and an air cleaning filter. The exhaust outlet coupling member is in close contact with an upper wall of the toner container around an exhaust outlet, and includes a skirt made of elastic silicone rubber that covers a joint part of the exhaust tube and the air outlet.

11 Claims, 8 Drawing Sheets

IMAGE FORMING APPARATUS AND TONER SUPPLY CONTAINER USED THEREFOR

This Nonprovisional application claims priority under 35 U.S.C. §119(a) on Patent Application No. 2007-289115 filed in Japan on 7 Nov. 2007, the entire contents of which are hereby incorporated by reference.

BACKGROUND OF THE TECHNOLOGY

1. Field of the Technology

The present technology relates to an image forming apparatus having a print function by an electrophotographic system, including a copier, a printer, a facsimile device, and the like, and a toner supply container used therefor.

2. Description of the Prior Art

An image forming apparatus using an electrostatic photographic system includes steps of charging, exposure, development, transfer, peeling, cleaning, charge erasing, and fixing. In the step of forming an image, for example, a surface of a photoreceptor drum which is driven to rotate is uniformly charged by a charger, and the charged surface of the photoreceptor drum is then exposed to laser light, thus forming an electrostatic latent image thereon. Subsequently, toner is electrostatically attached to the electrostatic latent image on the surface of the photoreceptor drum to develop, followed by forming a toner image on the photoreceptor drum. Then, the toner image on the photoreceptor drum is transferred onto a transfer material by a transfer apparatus, and the toner image on the transfer material is fixed by a heating and fixing apparatus. Moreover, residual transfer toner on the surface of the photoreceptor drum is removed by a cleaning apparatus and collected in a predetermined collecting portion, as well as residual electric charges on the surface of the photoreceptor drum after cleaning are removed by a charge erasing device to perform the following image formation.

As the photoreceptor drum, a photoreceptor drum to which an organic photoconductor (OPC) is applied as a photoconductive layer is generally used, and a corona charger is used as the charger for applying electric charges to the surface of the photoreceptor drum in many cases.

In one corona charger, a very thin conductive tungsten wire is covered with a conductive shield case in a peripheral portion except for a portion opposite to the photoreceptor drum, and a high voltage is applied to the tungsten wire itself so that corona discharge is caused to charge the photoreceptor drum. Besides, in another corona charger, a saw-toothed discharging electrode having many sharp projections arranged in line is disposed instead of the tungsten wire for corona discharge and the photoreceptor drum is charged by the corona discharge from the sharp projections. The corona charger is also used for the charge erasing device, the transfer apparatus, and the like, in addition to charge of the photoreceptor drum.

In the corona charger, when dirt adheres to a tungsten wire, a saw-toothed discharging electrode, or the like, a discharge function only in the corresponding part is deteriorated, thus making it impossible to charge the photoreceptor drum uniformly. When such charging irregularities are caused, image defects, such as a black streak in an obtained image, occur.

Furthermore, a prior technology for solving a problem about dirt on a needle-like electrode as described above is disclosed, for example, in Patent Literature 1. According to the technology disclosed in Patent Literature 1 (Japanese Patent Application Laid-Open Hei 7 No. 43990), the needle-like electrode is sandwiched, from both sides, by a cleaning member made of a pair of rollers supported rotatably and the cleaning member is relatively moved with respect to the needle-like electrode to thereby remove dirt adhering to the needle-like electrode.

Although this method is useful as a method for refreshing the needle-like electrode in which charging irregularities are caused, it is not to prevent dirt from adhering to a discharge electrode of a corona charger, and it is necessary to clean the corona charger frequently in order to obtain excellent image quality at all times.

SUMMARY OF THE TECHNOLOGY

In view of the aforementioned circumstances, the present technology provides an image forming apparatus that prevents foreign matters from adhering to a discharging electrode of a corona charger and that does not cause charging irregularities, and a toner supply container used therefor.

In order to solve the aforementioned problem, the present technology provides an image forming apparatus, including: a toner supply container that is detachably disposed, including an air inlet for taking air inside from outside and an exhaust outlet for discharging internal air to outside; an air blowing mechanism for sending air to the air inlet; and an exhaust mechanism for discharging air from the exhaust outlet.

According to the present technology, it is possible to prevent that volatile gas within the toner supply container disperses from the toner supply container into the image forming apparatus and foreign matters adhere to the discharge electrode of the corona charger to thereby cause charging irregularities.

Furthermore, the image forming apparatus of the present technology to solve the aforementioned problem is characterized in that the exhaust outlet has a filter which does not allow passage of toner.

According to the present technology, it is possible to prevent that toner is scattered outside mixed with air discharged from the toner supply container and to prevent that the inside of the image forming apparatus or the vicinity of the image forming apparatus becomes dirty.

Furthermore, the image forming apparatus of the present technology to solve the aforementioned problem is characterized in that the air inlet has an air valve for suppressing outflow of toner from inside to outside of the toner supply container or a filter which does not allow passage of toner.

According to the present technology, it is possible to prevent that toner is scattered outside from the air inlet and to prevent that the inside of the image forming apparatus or the vicinity of the image forming apparatus becomes dirty.

Furthermore, the image forming apparatus of the present technology to solve the aforementioned problem is characterized in that the air blowing mechanism includes an air blowing fan for drawing outside air in, an air blowing tube for leading air sent by the air blowing fan to the air inlet, and a coupling member for coupling the air blowing tube to the air inlet.

According to the present technology, since the air inlet coupling member is coupled with the air inlet, it is possible to send air into the toner supply container effectively with less air leakage.

Furthermore, the image forming apparatus of the present technology to solve the aforementioned problem is characterized in that the air inlet coupling member includes a skirt for sealing in the vicinity of the air inlet in the toner supply container, and the skirt has elasticity.

Since the air inlet coupling member includes the elastic skirt, it is possible to ensure airtightness even when irregularity is generated in dimensional accuracy of the toner supply container and the like, thus suppressing air leakage.

Furthermore, the image forming apparatus of the present technology to solve the aforementioned problem is characterized in that the exhaust mechanism includes an air cleaning filter for cleaning air discharged from the exhaust outlet, an exhaust tube for leading exhaust air to outside, and an exhaust outlet coupling member for coupling the exhaust outlet and the exhaust tube.

With the air cleaning filter, it is possible to prevent pollution of the ambient environment by volatile gas that is discharged being mixed with air discharged from the toner supply container. In addition, since the exhaust outlet coupling member is coupled with the exhaust outlet, it is possible to send volatile gas to the air cleaning filter without any leakage.

Furthermore, the image forming apparatus of the present technology to solve the aforementioned problem is characterized in that the air cleaning filter is an activated carbon filter.

Since the activated carbon filter has high ability of absorbing volatile gas, it is possible to use the filter for a long time and to reduce the frequency of replacement.

Furthermore, the image forming apparatus of the present technology to solve the aforementioned problem is characterized in that the exhaust outlet coupling member includes a skirt for sealing in the vicinity of the exhaust outlet in the toner supply container, and the skirt has elasticity.

Since the exhaust outlet coupling member includes the elastic skirt, it is possible to ensure airtightness even when irregularity is generated in dimensional accuracy of the toner supply container and the like, thus suppressing leakage of volatile gas discharged together with air.

Furthermore, the image forming apparatus of the present technology to solve the aforementioned problem is characterized in that the air blowing mechanism includes a humidity removing filter.

Since it is possible to send dry air into the toner supply container, it is possible to maintain a dry condition within the toner supply container even when the image forming apparatus is installed under a high humidity environment.

Furthermore, the image forming apparatus of the present technology to solve the aforementioned problem is characterized in that the humidity removing filter contains silica gel or calcium chloride.

Since the humidity removing filter has excellent hygroscopic ability, the filter can be used for a long time and the frequency of replacement can be reduced.

In order to solve the aforementioned problem, the present technology provides a toner supply container installed in and used for an image forming apparatus comprising an air blowing mechanism for sending air into the toner supply container and an exhaust mechanism for discharging air within the toner supply container, the toner supply container including: an air inlet for taking air sent from the air blowing mechanism; and an exhaust outlet for discharging air to the exhaust mechanism.

Even when storing toner that generates volatile gas causing charging irregularities when adhering to a corona discharging electrode, it is possible, after the image forming apparatus is installed, to purge volatile gas from the toner supply container, thus making it possible to prevent charging irregularities.

It is possible to remove volatile gas included in the toner supply container, thus making it possible to prevent that volatile gas disperses from the toner supply container into the image forming apparatus and foreign matters adheres to the discharge electrode of the corona charger to thereby cause charging irregularities.

DESCRIPTION OF THE PREFERRED EMBODIMENTS

Figure 1:
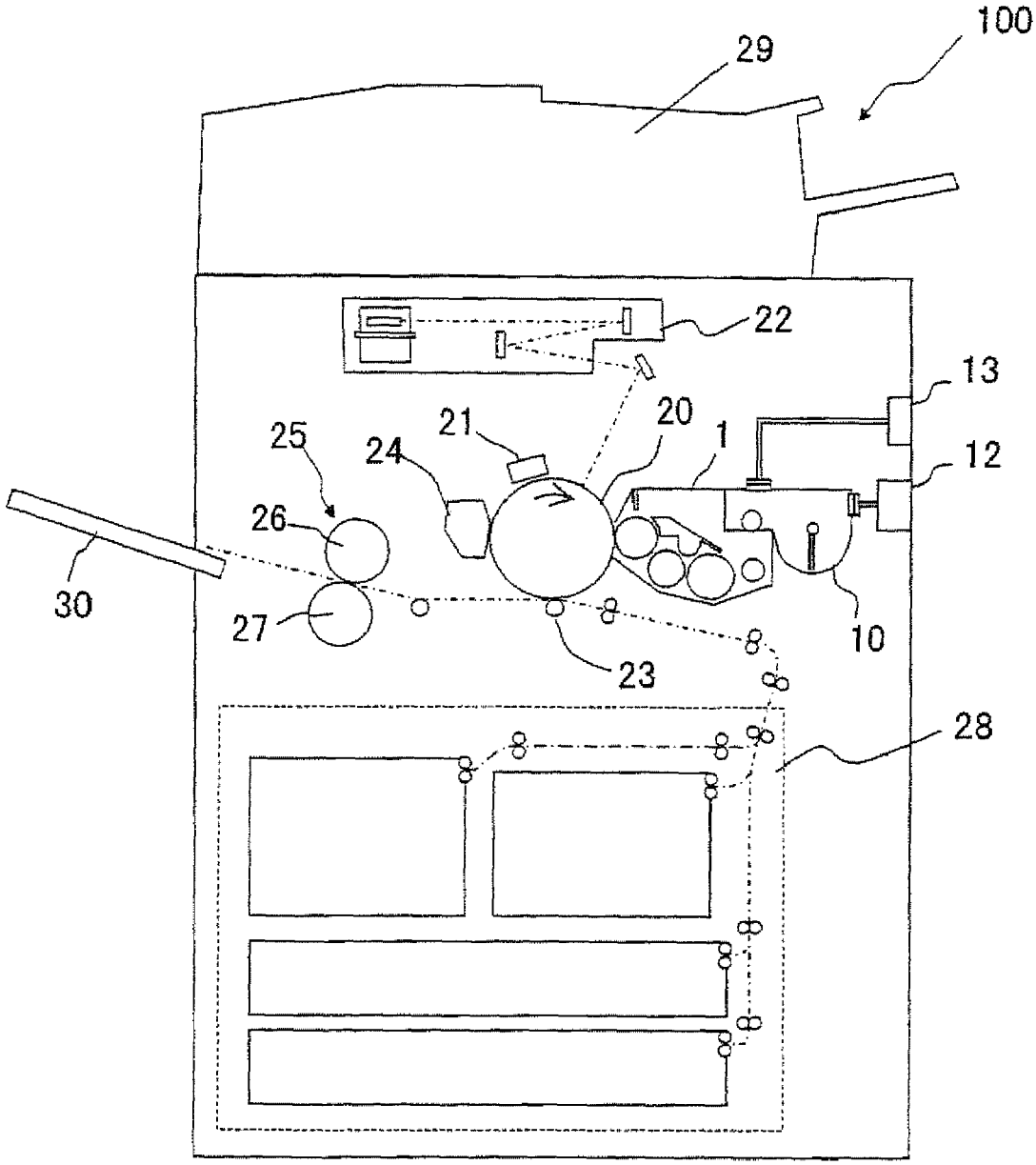
FIG. 1 is a sectional view schematically showing the configuration of an image forming apparatus.

The present technology provides an image forming apparatus capable of storing a detachably disposed toner supply container including: the detachably disposed toner supply container including an air inlet for taking air inside from outside and an exhaust outlet for discharging internal air to outside; an air blowing mechanism for sending air to the air inlet; and an exhaust mechanism for discharging air from the exhaust outlet, wherein volatile gas within the toner supply container is expelled and removed with air so as to prevent that the volatile gas disperses from the toner supply container into the image forming apparatus and impurities adheres to a discharge electrode of a corona charger, to thereby prevent charging irregularities.

In general toner stored in the toner supply container, inorganic fine particles, such as titanium oxide silica fine particles and titanium oxide fine particles, are applied in order to improve fluidity of toner particles. These inorganic find particles are subjected to a hydrophobic treatment with a silane coupling agent and the like so that an electric resistance does not fall under a high humidity environment. It was found that the foreign matters (silicon compound) adhering to the discharge electrode of the corona charger, that causes charging irregularities, are caused by a silicon compound derived from the silane coupling agent, and the present technology was completed to solve the above-mentioned problem.

The silane coupling agent is bound to oxygen on a surface of inorganic fine particles to form a strong film, but a part of which remains adhered without being bound to the inorganic fine particles (in an unreacted state). Although the silane coupling agent and most of the unreacted silicon compound derived from the silane coupling agent are volatilized in a heating process in the hydrophobic treatment of the inorganic fine particles and are released from the surface of the inorganic fine particles, a part of the unreacted silicon compound is considered to remain on the surface of the inorganic fine particles.

Moreover, as shown in the following formula, since the silane coupling agent such as HMDS reacts with moisture in air and is hydrolyzed to a highly volatile silicon compound (trimethylsilanol), it is considered that a concentration of volatilized gas composed of the silicon compound within the toner supply container gradually becomes high.

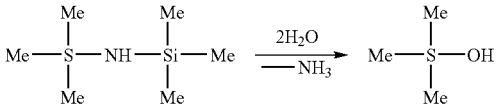

In the image forming apparatus of the present technology, by sending air into the toner supply container, it is possible to lower the concentration of volatilized gas composed of the silicon compound within the toner supply container, thus preventing that the volatilized gas composed of the silicon compound disperses into the image forming apparatus and is accumulated on the discharging electrode of the corona charger as impurities, resulting that charging irregularities can be prevented.

Now, referring to the accompanying drawings, embodiments of the present technology will hereinafter be described.

Figure 2:
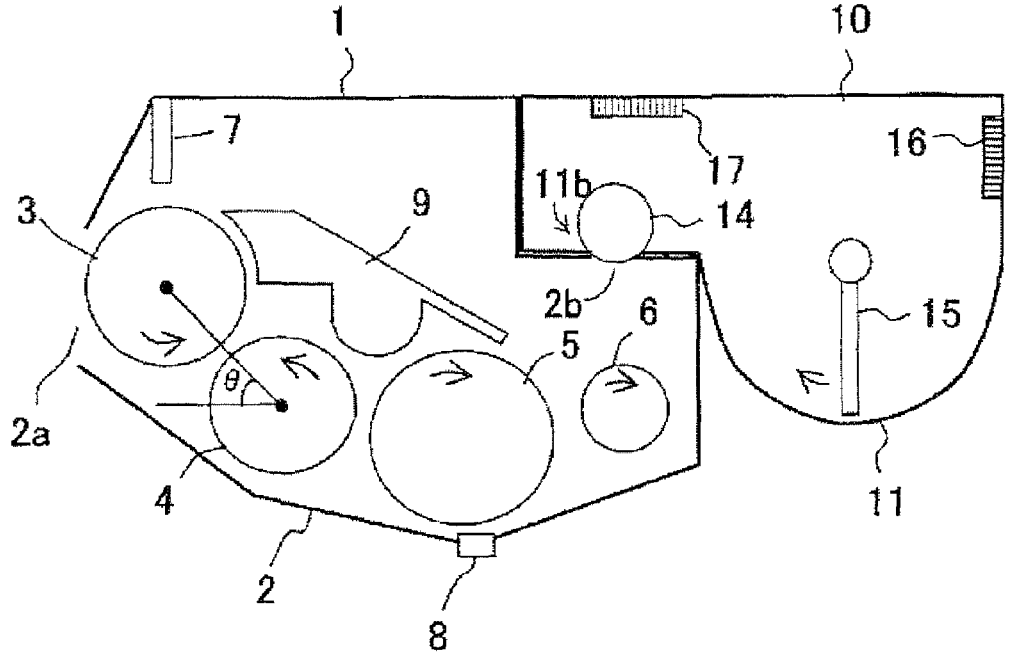
FIG. 2 is a sectional view showing the configuration of a developing unit and a toner supply container.
Figure 3:
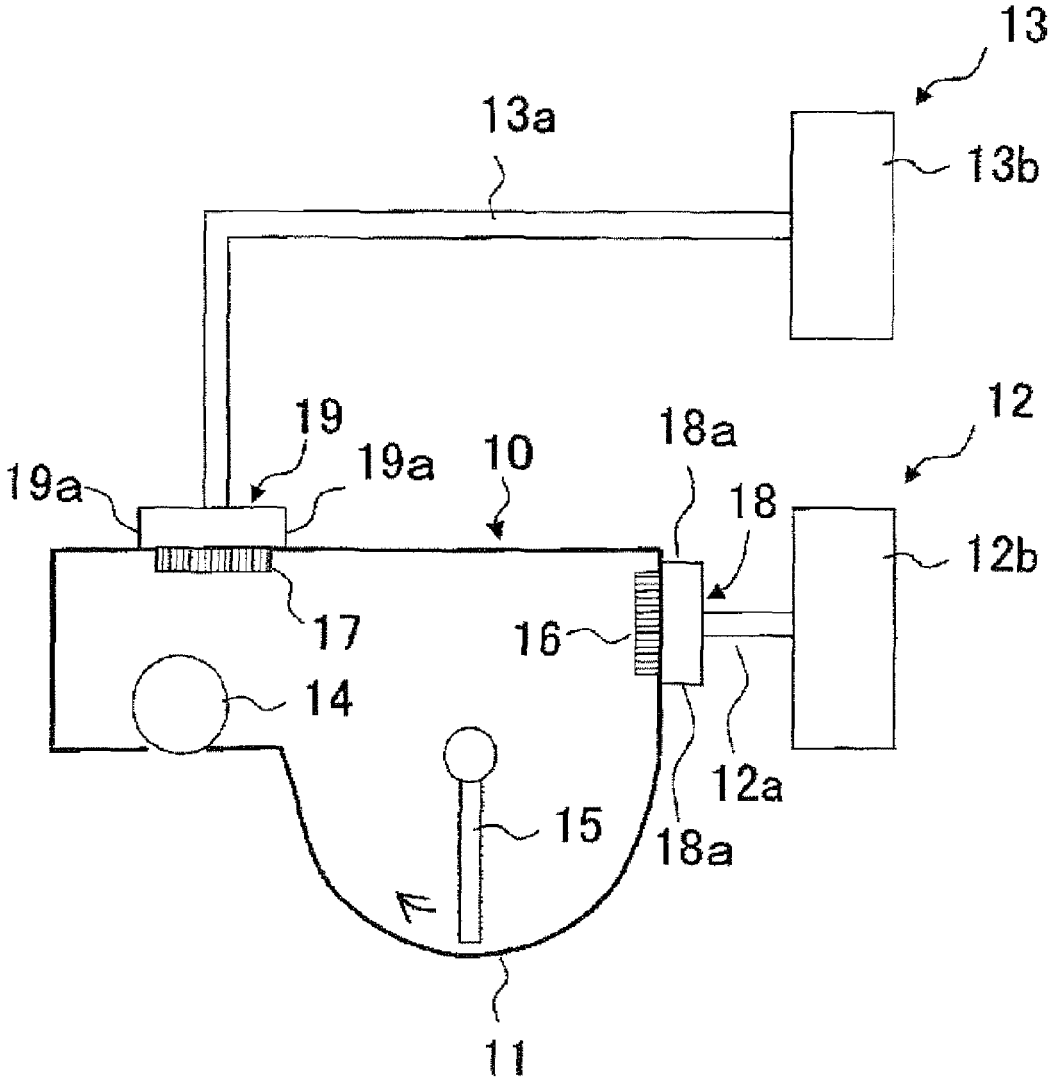
FIG. 3 is an enlarged view of the toner supply container, an air blowing mechanism, and an exhaust mechanism in FIG. 1.
Figure 4:
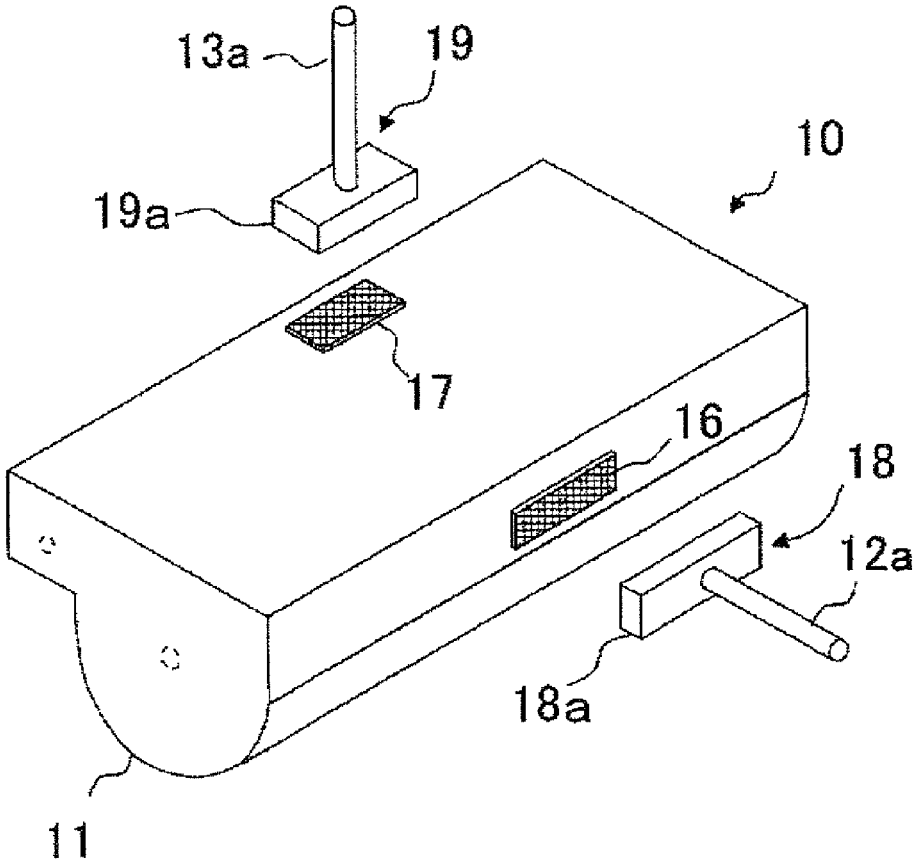
FIG. 4 is an exploded perspective view of the toner supply container, the air blowing mechanism, and the exhaust mechanism in FIG. 3.
Figure 5:
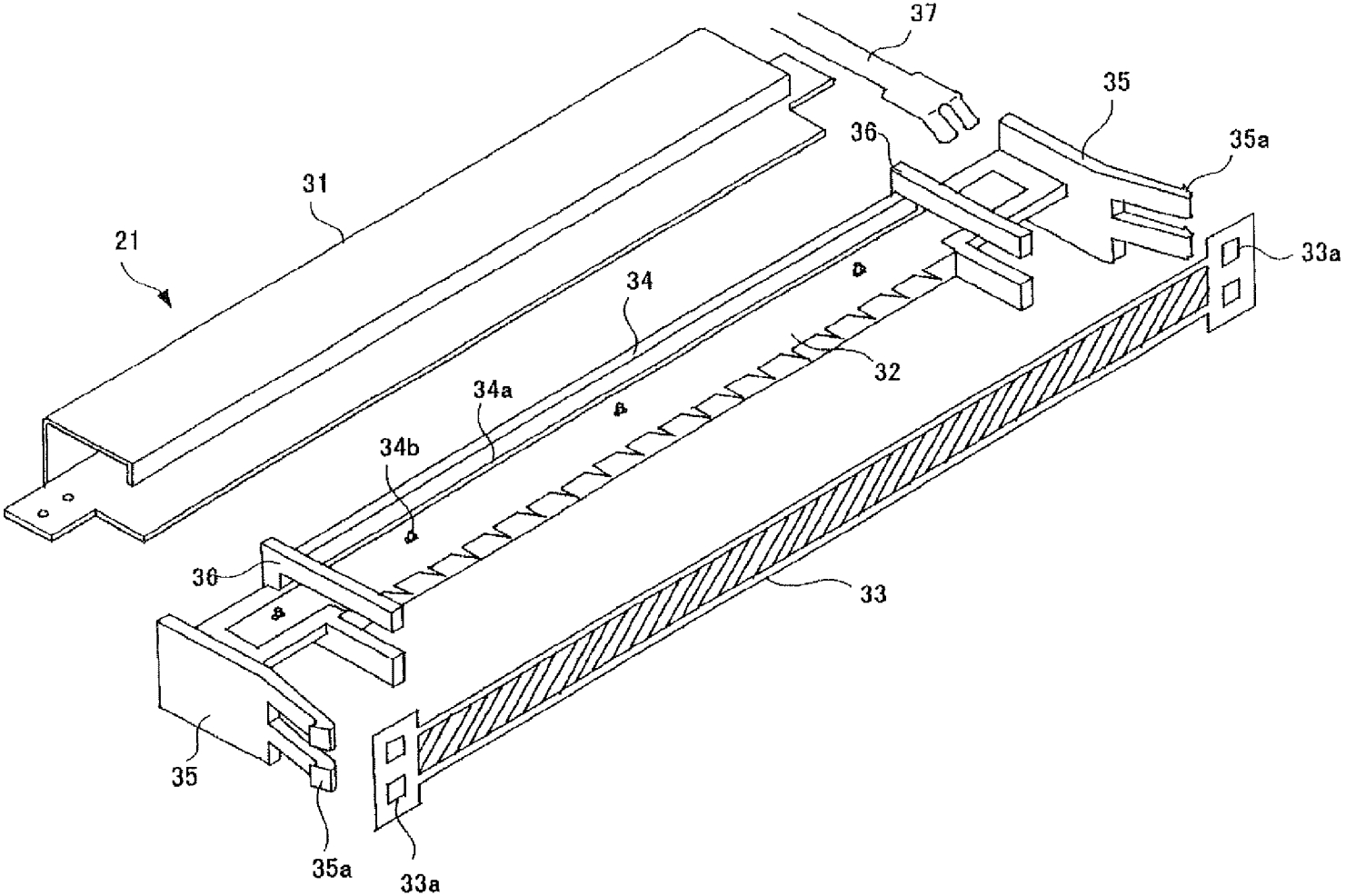
FIG. 5 is a development perspective view showing the configuration of a corona charger.
Figure 6:
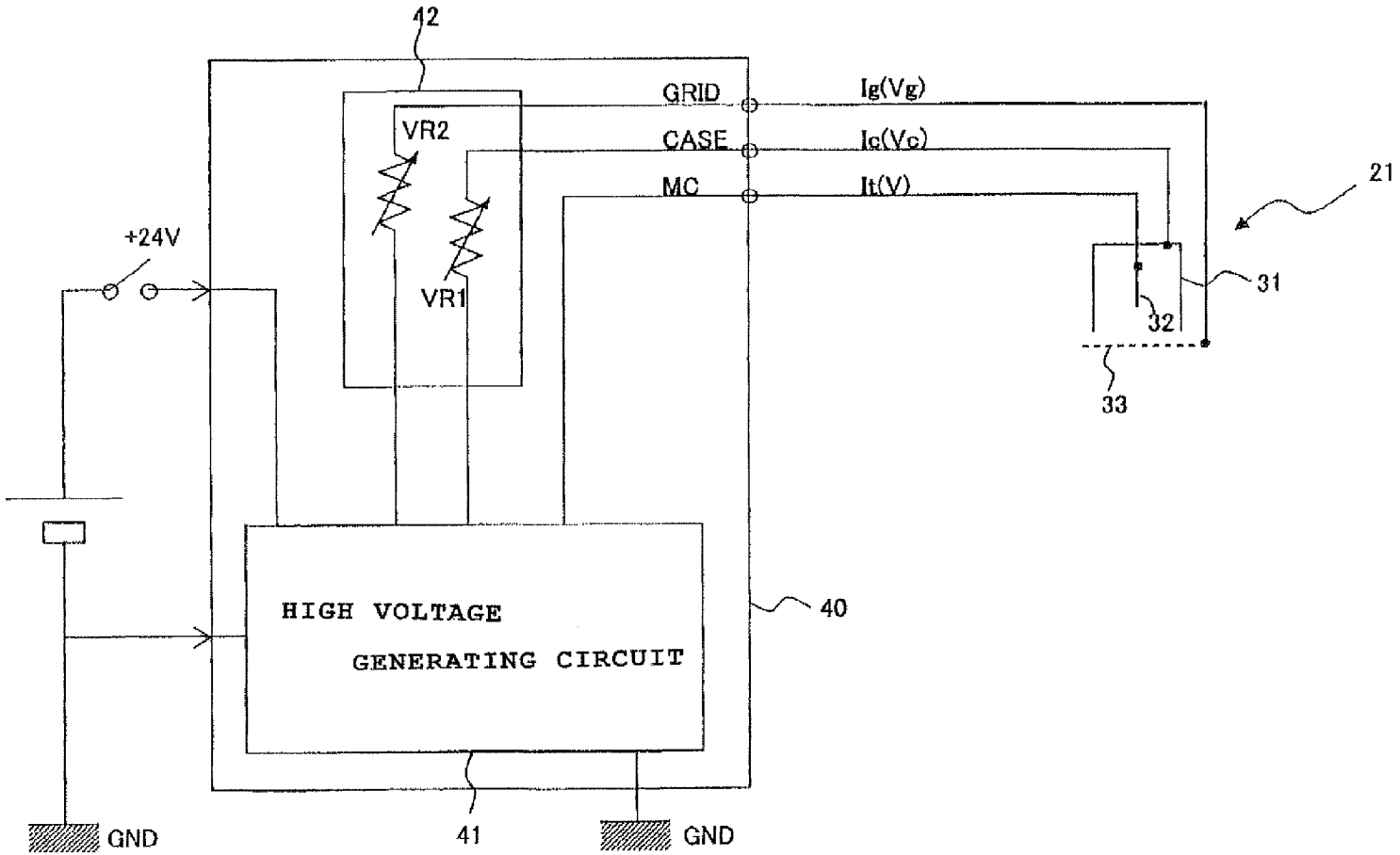
FIG. 6 is a block diagram showing an example of a power supplying circuit including a high voltage circuit for supplying a voltage to the corona charger.
Figure 7:
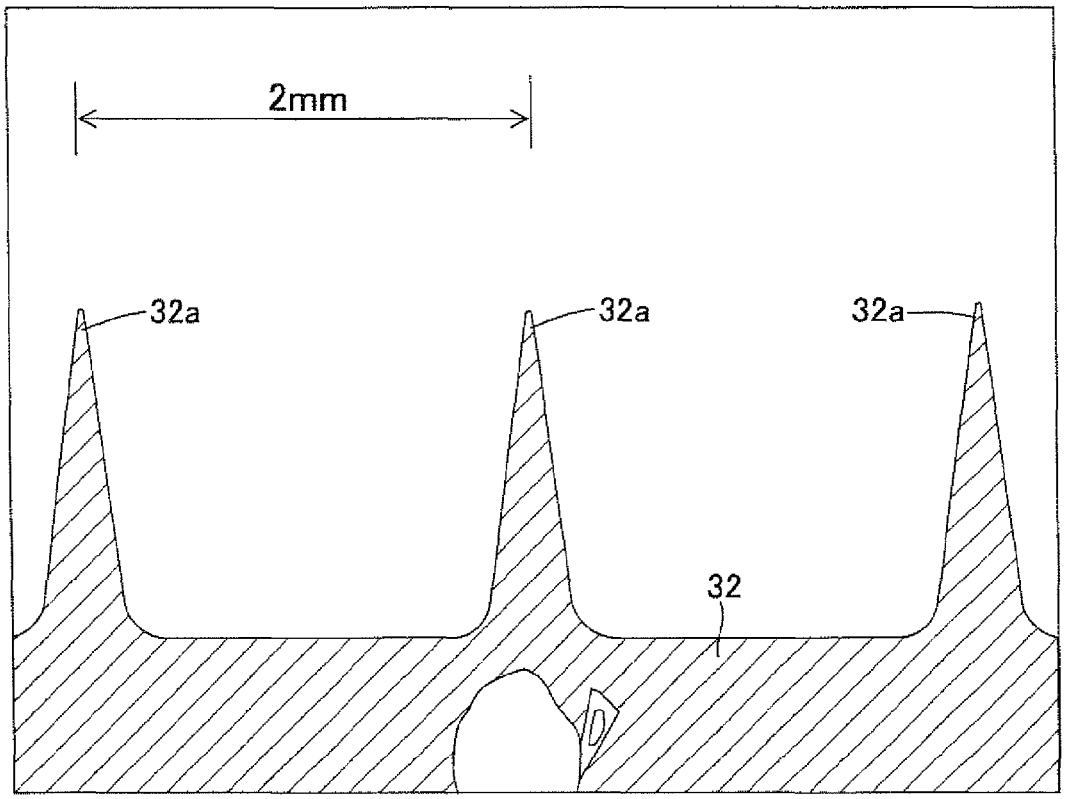
FIG. 7 is a schematic drawing of a saw-toothed charger without a substance adhered to a tip portion thereof after a printing test in an example.
Figure 8:
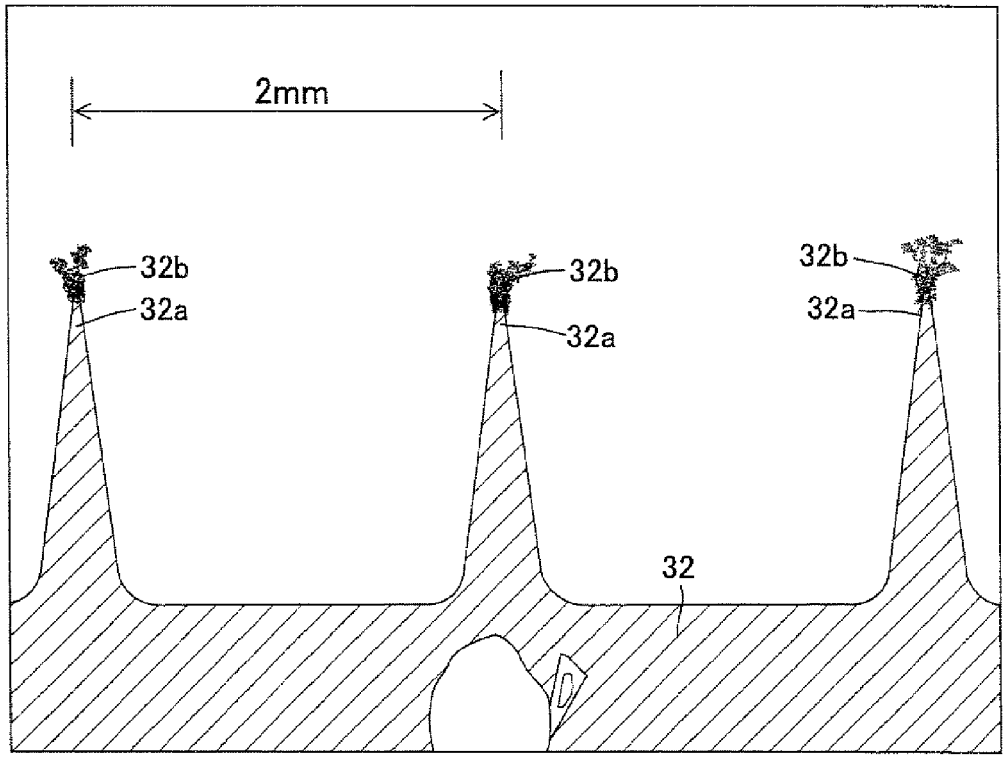
FIG. 8 is a schematic drawing of the saw-toothed charger with a substance adhered to the tip portion thereof after a printing test in a comparative example.

FIGS. 1 to 6 show an example of the embodiments, and FIG. 1 is a sectional view schematically showing the configuration of the image forming apparatus. FIG. 2 is a sectional view showing the configuration of a developing unit and a toner supply container. FIG. 3 is an enlarged view of the toner supply container 10, an air blowing mechanism 12, and an exhaust mechanism 13 in FIG. 1. FIG. 4 is an exploded perspective view of the toner supply container 10, the air blowing mechanism 12, and the exhaust mechanism 13 in FIG. 3. FIG. 5 is a development perspective view showing the configuration of a saw-toothed charger. FIG. 6 is a block diagram showing an example of a power supplying circuit including a high voltage circuit for supplying a voltage to a corona charger. FIG. 7 is a schematic drawing of the saw-toothed charger without a substance adhered on a tip portion thereof after a printing test in an embodiment. FIG. 8 is a schematic drawing of the saw-toothed charger with a substance adhered on the tip portion thereof after a printing test in a comparative example.

As shown in FIG. 1, the image forming apparatus 100 is a digital copier having a copy mode and a print mode, that prints, depending on image information of a document read by a scanner portion 29, which will be described below, a copied material of the document in the copier mode, and that prints, depending on image information from an external device connected through a network to the image forming apparatus 100, an image corresponding thereto in the print mode. The image forming apparatus 100 includes the developing unit 1, the toner supply container 10, the air blowing mechanism 12, the exhaust mechanism 13, a photoreceptor drum 20, a corona charger 21, an exposure unit 22, a transfer unit 23, a fixing unit 25, a cleaning unit 24, a paper feed tray 28, the scanner portion 29, and a paper output tray 30.

FIG. 2 is a sectional view showing the configuration of the developing unit and the toner supply container. The developing unit 1 includes a development tank 2, a developing roller 3, a first agitating member 4, a second agitating member 5, a conveying member 6, a regulating member 7, a toner concentration detecting sensor 8, and a flow board 9.

The development tank 2 that is a container-shaped member having an approximately rectangular column shape and having an internal space, supports the developing roller 3, the first agitating member 4, the second agitating member 5, and the conveying member 6 rotatably, and supports the regulating member 7, the flow board 9, and the like directly or indirectly, to store developer therein. The developer is two-component developer including toner and carrier of magnetic powder. Moreover, when the developing unit 1 is mounted on the electrophotographic image forming apparatus 100, the development tank 2 is formed with an opening 2*a* at a side facing the photoreceptor drum 20 in the image forming apparatus 100. The developer tank 2 is also formed with a toner supply port 2*b* at an upper side in a vertical direction.

The developing roller 3 is a roller member that is rotatably supported in the development tank 2 and that is driven for rotation around an axis by driving means (not shown). Moreover, the developing roller 3 faces the photoreceptor drum 20 through the opening 2*a* of the development tank 2. The developing roller 3 is provided so as to be separated from the photoreceptor drum 20 with a gap therebetween, and a most adjacent portion serves as a development nip portion. In the development nip portion, toner is supplied from a developer layer (not shown) on a surface of the developing roller 3 to an electrostatic latent image on the surface of the photoreceptor drum 20. In the development nip portion, a development bias voltage is applied to the developing roller 3 from a power source (not shown) connected to the developing roller 3 so that toner is carried smoothly from the developer layer on the surface of the developing roller 3 to the surface of the photoreceptor drum 20. In the present embodiment, the toner supply roller 14 rotates counterclockwise and the photoreceptor drum 20 rotates clockwise.

Each of the first agitating member 4 and the second agitating member 5 is a roller member that is rotatably supported in the development tank 2 and that is provided so as to be rotatably driven around an axis by driving means (not shown). In the present embodiment, the first agitating member 4 rotates counterclockwise and the second agitating member 5 rotates clockwise. The first agitating member 4 is provided at a position facing the photoreceptor drum 20 through the developing roller 3 so as to be positioned downward from the developing roller 3 in the vertical direction. In the present embodiment, an installation angle θ of the first agitating member 4, that is an angle formed by a straight line extending in parallel from an axial center of the first agitating member 4 to the developing roller 3 side and a straight line connecting an axial center of the developing roller 3 and that of the first agitating member 4 is 54°. The second agitating member 5 is provided at a position facing the developing roller 3 through the first agitating member 4 so as to be positioned downward from the developing roller 3 in the vertical direction. The first agitating member 4 and the second agitating member 5 agitate developer reserved within the development tank 2, apply electric charges to the toner uniformly, and take up the charged developer to thereby convey to the vicinity of the developing roller 3.

The conveying member 6 is a roller member that is rotatably supported in the development tank 2 and that is provided so as to be rotatably driven by driving means (not shown). The conveying member 6 faces the first agitating member 4 through the second agitating member 5 and is provided so as to be positioned downward from the toner supply port 2*b* in the vertical direction. The conveying member 6 conveys the toner supplied through the toner supply port 2*b* into the development tank 2 to the vicinity of the second agitating member 5.

The toner supply container 10 includes, within the internal space thereof, a toner container 11, a toner supply roller 14, and a toner take-up roller 15, and is provided detachably with respect to a main body of the image forming apparatus 100 shown in FIG. 1.

The toner container 11 is a container-shaped member for storing toner, and supports the toner supply roller 14 and the toner take-up roller 15 rotatably. Moreover, when the toner supply container 10 is mounted on the image forming apparatus 100 of FIG. 1, the toner container 11 is formed with a toner discharge port 11*b* so as to communicate with the toner supply port 2*b* in the vertical direction, the supply port 2*b* being an opening formed on the upper face of the development tank 2 in the vertical direction, and is formed with the toner supply roller 14 at an upper side thereof in the vertical direction.

The toner supply roller 14 is driven for rotation by driving means (not shown). The rotational drive of the toner supply roller 14 is controlled by control means (not shown) provided in the image forming apparatus 100 depending on a detection result of a toner concentration within the development tank 2 by the toner concentration detecting sensor 8. With the rotational drive of the toner supply roller 14, the toner is supplied into the development tank 2 through the toner discharge port 11*b* and the toner supply port 2*b*.

Moreover, the toner container 11 is formed with an air inlet 16 and an exhaust outlet 17 at an upper part of the side wall and an upper face in the vertical direction, respectively. Each of the air inlet 16 and the exhaust outlet 17 is provided with a toner filter which does not allow passage of the toner. The air inlet 16 may be provided with an air valve for suppressing outflow of the toner from inside to outside of the toner supply container 10, instead of the toner filter. It is possible to prevent that the toner is scattered outside from the air inlet 16 and that the inside of the image forming apparatus 100 or the vicinity of the image forming apparatus 100 becomes dirty.

FIG. 3 is an enlarged view of the toner supply container 10, the air blowing mechanism 12, and the exhaust mechanism 13 in FIG. 1, and FIG. 4 is an exploded perspective view of the toner supply container 10, the air blowing mechanism 12, and the exhaust mechanism 13 in FIG. 3

The air blowing mechanism 12 includes an air blowing fan 12*b*, an air blowing tube 12*a*, and an air inlet coupling member 18. The air inlet coupling member 18 is configured so as to be in close contact with a side wall of the toner container 11 around the air inlet 16, to include a skirt 18*a* made of elastic silicone rubber that covers a joint part of the air blowing tube 12*a* and the air inlet 16, and to seal the air inlet 16 to prevent air leakage. This elastic skirt 18*a* functions as a shock absorbing material when the toner supply container 10 is detachably disposed to the image forming apparatus 100 so as to make it easier to detachably dispose the toner supply container 10, and to ensure airtightness even when irregularity is generated in dimensional accuracy of the toner supply container 10 and the like, thus preventing air leakage, and resulting that it is possible to send air into the toner supply container 10 effectively. It is also possible to provide a humidity removing filter in middle of the air blowing tube 12*a*. This makes it possible to send dry air into the toner supply container 10, resulting that, even when the image forming apparatus 100 is installed under a high humidity environment, it is possible to maintain a dry condition within the toner supply container 10, to stabilize charging characteristics of the toner, and to suppress hydrolyzation of the unreacted silicone compound. As a dehumidifying agent used for the humidity removing filter, silica gel or calcium chloride can be used. Due to its excellent hygroscopic ability, the filter can be used for a long time and the frequency of replacement can be reduced.

The exhaust mechanism 13 includes an exhaust outlet coupling member 19, an exhaust tube 13*a*, and an air cleaning filter 13*b*. The air cleaning filter 13*b* is capable of capturing volatilized gas discharged being mixed with the air ejected from the toner supply container to prevent pollution of the ambient environment. The air cleaning filter is preferably an activated carbon filter, and, due to its excellent ability of absorbing the volatilized gas, the filter can be used for a long time and the frequency of replacement can be reduced.

The exhaust outlet coupling member 19 is configured so as to be in close contact with an upper wall of the toner container 11 around the exhaust outlet 17, to include a skirt 19*a* made of elastic silicone rubber that covers a joint part of the exhaust tube 13*a* and the exhaust outlet 17, and to seal the exhaust outlet 17 to prevent air leakage. This elastic skirt 19*a* functions as a shock absorbing material when the toner supply container 10 is detachably disposed to the image forming apparatus 100 so as to make it easier to detachably dispose the toner supply container 10, and to ensure airtightness even when irregularity is generated in dimensional accuracy of the toner supply container 10 and the like, thus preventing air leakage, and resulting that it is possible to prevent the volatilized gas mixed with the air discharged from the toner supply container 10 from dispersing into the image forming apparatus 100 or around the image forming apparatus 100 without any leakage.

A specific method for sending air to the toner supply container 10 is such that, after the toner supply container 10 is mounted on the image forming apparatus 100, an air blowing process is performed at a ratio of five liters per minute when a capacity of the toner supply container 10 is one liter. Further, by performing the air blowing process periodically for every week, it is possible to remarkably reduce dispersion of the silicon compound within the image forming apparatus 100 and to prevent generation of charging irregularities.

The photoreceptor drum 20 is a roller member that is supported so as to be rotatably driven around an axis by driving means (not shown), and that has a photosensitive film having an electrostatic latent image and then a toner image formed on the surface thereof. As the photoreceptor drum 20, for example, a roller member including a conductive substrate (not shown) and a photosensitive film (not shown) formed on a surface of the conductive substrate can be used. As the conductive substrate, cylindrical, column-shaped, and sheet-shaped conductive substrates can be used, and the cylindrical conductive substrate is preferable. Examples of the photosensitive film include an organic photosensitive film and an inorganic photosensitive film.

Examples of the organic photosensitive film include a laminated photoreceptor drum formed of a charge generating layer which is a resin layer including a charge generating substance and a charge transporting layer which is a resin layer including a charge transporting substance, and a monolayer photoreceptor drum including a charge generating substance and a charge transporting substance in a single resin layer. An example of the inorganic photosensitive film includes a film containing one or more selected from zinc sulfide, selenium, amorphous silicon, and the like. A base film may be interposed in between the conductive substrate and the photosensitive film, and a surface film (a protecting film) for mainly protecting the photosensitive film may be provided on the surface of the photosensitive film.

The corona charger 21 charges the surface of the photoreceptor drum 20 at predetermined electrode or potential by corona discharge. As the corona charger 21, a saw-toothed charger including a saw-toothed discharging electrode and a scorotron charger including a tungsten wire can be used.

FIG. 5 is a development perspective view showing the configuration of the corona charger 21.

The corona charger 21 is constructed by a conductive shield case 31, a saw-toothed electrode 32, a grid electrode 33, and an insulative electrode holding member 34 for holding various kinds of electrodes. The shield case 31 is a conductive shield plate having a length approximately equal to in a width direction of the photoreceptor drum 20 (in the direction of a rotational axis of the drum), which is opened on a side opposite to the surface of the photoreceptor drum 20. The saw-toothed electrode 32 has a plurality of sharp projections for discharge arranged in line at a predetermined space (2 mm), and is constructed by a thin plate having a shape of a short strip made of stainless steel (such as an alloy of iron, chromium and nickel, and an example thereof includes SUS304 in JIS). Such a saw-toothed electrode 32 is formed by etching process.

The saw-toothed electrode 32 has a plurality of openings for fixing. Each of these openings is fitted onto a projecting portion 34*b* formed in a plane-shaped portion 34*a* of the electrode holding member 34 integrally formed by an insulating member. Thus, the saw-toothed electrode 32 is positioned and held (fixed) by the shield case 31 in an electrically insulated state in the plane-shaped portion 34*a* of the electrode holding member 34.

As the corona charger, in addition to the saw-toothed charger using the saw-toothed electrode above, a charger using a charger wire as a discharging electrode, or the like can be used.

A grid electrode holding portion 35 for electrically insulating and holding the grid electrode 33 with respect to the shield case 31 and the saw-toothed electrode 32 is integrally formed in the electrode holding member 34. This grid electrode holding portion 35 has an engaging portion 35*a* having a returning portion for engagement and corresponding to an opening portion 33*a* formed at each of both ends of the grid electrode 33. When the grid electrode holding portion 35 is elastically deformed, the engaging portion 35*a* is inserted into the opening portion 33*a* of the grid electrode 33 and the elastic deformation is released, and thereby the grid electrode 33 is held by elastic force as predetermined tensile force.

In the grid electrode 33 above, mesh-shaped openings are uniformly formed by etching a thin plate having a shape of a short strip made of stainless steel as in the saw-toothed electrode 32 above. The grid electrode holding portion 35 integrally molded with the electrode holding member 34 is elastically deformed so as to, be inserted into an opening formed in the grid electrode 33 and engaged therewith, thus being tensioned by elastic force.

A positioning member 36 is arranged in accordance with each of both end edges of the shield case 31 to position the electrode holding member 34 within the shield case 31, and is integrally molded with the electrode holding member 34.

When the corona charger 21 having the above structure is assembled, a projection of the plane-shaped portion 34*a* of the electrode holding member 34 is firstly fitted and held into an opening formed in the saw-toothed electrode 32 so that the positioning member 36 is positioned and disposed at an end edge of the shield case 31 in a predetermined position within the shield case 31 above in a state where the saw-toothed electrode 32 is held. The engaging portion 35*a* of the grid electrode holding portion 35 is inserted into the opening portion 33*a* of the grid electrode 33 and is engaged therewith. Moreover, a spring terminal 37 electrically comes in elastic contact with an end portion of the saw-toothed electrode 32 located in the electrode holding member 34 projected from the shield case to supply power.

FIG. 6 is a block diagram showing an example of a power supplying circuit including a high voltage generating circuit for supplying a voltage to the corona charger 21. As shown in FIG. 6, predetermined voltages are applied to the electrode of the corona charger 21 and the shield case 31 from a power supplying circuit 40. In FIG. 6, a predetermined voltage of +24 V is supplied to the power supplying circuit 40. A high voltage generating circuit 41 for converting the supplied voltage +24 V to a predetermined voltage to output is disposed within the power supplying circuit 40. This high voltage generating circuit 41 generates voltages to be supplied to the shield case 31, the saw-toothed electrode 32, and the grid electrode 33 in the corona charger 21. These generating voltages are output as predetermined voltages by each output terminal. As described below, a voltage adjusting circuit 42 that adjusts voltages generated from the high voltage generating circuit 41 when supplying voltages to the shield case 31 and the saw-toothed electrode 32 in the corona charger 21 is further disposed in the power supplying circuit 40.

The saw-toothed electrode 32 in the corona charger 21 is connected to an output terminal MC of the power supplying circuit 40 and is supplied with a high voltage V. Moreover, the shield case 31 is connected to an output terminal CASE of the power supplying circuit 40 and is supplied with a high voltage Vc. Further, the grid electrode 33 is connected to an output terminal GRID of the voltage adjusting circuit 42 and is supplied with a high voltage Vg. The voltage adjusting circuit 42 above has a variable resistor VR1 for adjusting an output voltage from the output terminal CASE to supply to the shield case 31, and a variable resistor VR2 for adjusting an output voltage from the output terminal GRID to supply to the grid electrode 33.

Various kinds of voltages are supplied to the corona charger 21 by the power supplying circuit 40 having the above configuration so that corona discharge is caused from a projecting tip portion of the saw-toothed electrode 32 and an entire electric current (a total electric current It) caused by the corona discharge flows through the saw-toothed electrode 32. In this case, a grid current Ig flowing through the grid electrode 33 can be adjusted by appropriately setting the variable resistor VR2 of the voltage adjusting circuit 42 to change the voltage output from the output terminal GRID. Similarly, a case electric current Ic caused by the discharge also flows through the shield case 31 by the corona discharge. The case electric current Ic can be also controlled by adjusting the variable resistor VR1 to change the supplied voltage.

The electric current It provided by the corona discharge caused by supplying a high voltage to the saw-toothed electrode 21 is equal to a sum of the case electric current Ic and the grid current Ig respectively flowing through the shield case 31 and the grid electrode 33. That is, the electric current (total electric current) It flowing through the saw-toothed electrode 21 by the corona discharge is distributed and flows through the shield case 31 and the grid electrode 33. The total electric current It is distributed into the case electric current Ic and the grid current Ig, and is represented by the following formula (I).

$$It=Ic+Ig+Id \quad (1)$$

Thus, by making the total electric current It constant, the electric current flowing through the saw-toothed electrode 21 can be controlled so as to be constant, and therefore constant control for electric current including a constant current control portion is carried out in the high voltage generating circuit 41 of the power supplying circuit 40.

A laser scanning device including a light source is used for the exposure unit 22. The laser scanning device is formed by combining, for example, a light source, a polygon mirror, an fθ lens, a reflection mirror, and the like. As the light source, a semiconductor laser, an LED array, an electroluminescence (EL) element, or the like can be used.

The exposure unit 22 is input with image information of a document read by the scanner portion 29 or image information from an external device, and irradiates signal light corresponding to the image information to the charged surface of the photoreceptor drum 20. Thereby, an electrostatic latent image corresponding to the image information is formed on the surface of the photoreceptor drum 20.

The transfer unit 23 is a roller member that is rotatably supported by a support member (not shown), and that is provided so as to be rotatable by driving means (not shown) and to be in press contact with the photoreceptor drum 20. As the transfer unit 23, for example, a roller member including a metal cored bar whose diameter is 8 through 10 mm and a conductive elastic layer formed on the surface of the metal cored bar is used. As the metal forming the metal cored bar, stainless steel, aluminum, and the like can be used. As the conductive elastic layer, a rubber material formed by blending a conductive material such as carbon black with a rubber material such as Ethylene Propylene rubber (EPDM), EPDM foam, and urethane foam can be used. In synchronization with conveyance of a toner image to a press-contact portion (a transfer nip portion) of the photoreceptor drum 20 and the transfer unit 23 by rotation of the photoreceptor drum 20, recording mediums are supplied one by one from the paper feed tray 28 through a pick-up roller and a registration roller (not shown).

When the recording medium passes through the transfer nip portion, a toner image on the surface of the photoreceptor drum 20 is transferred onto the recording medium. A power source (not shown) is connected to the transfer unit 23, and, when the toner image is transferred onto the recording medium, applies a voltage having a polarity opposite to a charging polarity of toner to the transfer unit 23. Thereby, the toner image is transferred onto the recording medium smoothly. By means of the transfer unit 23, the toner image on the surface of the photoreceptor drum 20 is transferred onto the recording medium.

The cleaning unit 24 includes a cleaning blade (not shown) and a toner reservoir (not shown). The cleaning blade is a plate member that is provided so as to extend in parallel in a longitudinal direction of the photoreceptor drum 20, and so that one end thereof in a lateral direction contacts with the surface of the photoreceptor drum 20. The cleaning blade removes toner and paper powder remaining on the surface of the photoreceptor drum 20 after the toner image is transferred onto the recording medium, from the surface of the photoreceptor drum 20. The toner reservoir is a container-like member having an internal space therein, and temporarily reserves toner removed by the cleaning blade. The surface of the photoreceptor drum 20 after transfer of the toner image is cleaned by the cleaning unit 24.

The fixing unit 25 includes a fixing roller 26 and a pressing roller 27. The fixing roller 26 is a roller member that is rotatably supported by a support member (not shown) and that is provided so as to be rotatable around an axis by driving means (not shown). The fixing roller 26 has a heating member (not shown) therein, and heats and fuses toner constituting unfixed toner image carried by the recording medium which is transported from the transfer nip portion to fix onto the recording medium. As the fixing roller 26, for example, a roller member including a cored bar and an elastic layer is used. The cored bar is formed by metal such as iron, stainless steel, and aluminum. The elastic layer is formed by an elastic material such as, for example, silicone rubber and fluororubber. The heating member is applied with a voltage from the power source (not shown) to generate heat. As the heating member, a halogen lamp, an infrared lamp, and the like can be used.

The pressing roller 27 is a roller member that is rotatably supported and that is provided so as to be in press contact with the fixing roller 26 by a pressing member (not shown). The pressing roller 27 is driven for rotation by rotation of the fixing roller 26. A press-contact portion of the fixing roller 26 and the pressing roller 27 is a fix nip portion. When the fixing roller 26 heats and fixes the toner image to the recording medium, the pressing roller 27 presses the fused toner onto the recording medium to facilitate fixing of the toner image to the recording medium. As the pressing roller 27, a roller member having the same configuration as that of the fixing roller 26 can be used. The pressing roller 27 may also have a heating member therein. As the heating member, a heating member same as that in the fixing roller 26 can be used.

According to the fixing unit 25, the recording medium having the toner image transferred thereon passes through the fix nip portion, and toner constituting the toner image is fused and pressed onto the recording medium so that the toner image is fixed to the recording medium and an image is printed. The recording medium having the image printed thereon is ejected and placed by transport means (not shown) onto the output tray 30 provided in a side face of the image forming apparatus 100 in the vertical direction.

The paper feed tray 28 is a tray for storing recording medium such as a standard paper, a coated paper, a color copy paper, and an OHP film. A plurality of the paper feed trays 28 are provided and each of which stores a recording medium having a different size, respectively. The sizes of the recording medium include A3, A4, B5, and B4. Moreover, the plurality of paper feed trays 28 may store the recording medium of the same size. In synchronization with conveyance of the toner image on the surface of the photoreceptor drum 20 to the transfer nip portion, recording mediums are delivered one by one by a pick-up roller, a transport roller, and a registration roller, that are not shown.

The scanner portion 29 is provided with a document set tray and a recirculating automatic document feeder (RADF), and further provided with a document reading apparatus (not shown).

The automatic document feeder transports a document placed on the document set tray to a document table of the document reading apparatus. The document reading apparatus includes the document table, a document scanning device, a reflection member, a charge coupled device (CCD) line sensor, and the like, and reads image information of the document placed on the document table by a plurality of lines, for example, by ten lines. The document table is a glass plate member on which a document is placed so that an image information is read. The document scanning device includes a light source and a first reflection mirror, that are not shown, reciprocates in parallel along a lower surface of the document table in the vertical direction at a constant velocity V, and irradiates light to a surface to be subjected to image formation of the document placed on the document table.

A reflected light image is obtained by irradiation of light. The light source is a source of light to irradiate to the document placed on the document table. The first reflection mirror reflects the reflected light image toward the reflection member. The reflection member includes a second reflection mirror, a third reflection mirror, and an optical lens, that are not shown, and forms the reflected light image obtained by the document scanning device on the charge coupled device line sensor. The reflection member reciprocates at a velocity of V/2 following the reciprocating movement of the document scanning device. The second and third reflection mirrors reflect the reflected light image so as to lead the reflected light image to the optical lens. The optical lens forms the reflected light image on the charge coupled device line sensor. The CCD line sensor includes a CCD circuit (not shown) for photoelectrically converting the reflected light image formed by the optical lens into an electric signal, and outputs the electric signal serving as image information to an image processing portion in control means. The image processing portion converts the image information input from the document reading apparatus or an external apparatus such as a personal computer into an electric signal to output to the exposure unit 22.

As described above, in the image forming apparatus, it will not occur that dirt adheres to the discharging electrode of the corona charger resulting that uniform discharge is interrupted, thus charging irregularities is not likely to occur in discharging and a stable image having no black streak can be obtained over a long period. Moreover, in the saw-toothed charger capable of providing a good environment with little generation of ozone, the discharging electrode has a needle shape so that foreign matters concentratedly adhere to a tip and charging irregurarities are likely to occur. However, in the image forming apparatus using the present technology, a stable image having no black streak can be obtained with little generation of ozone over a long period.

EXAMPLES

After performing an air blowing operation to the toner supply container 10, an aging test was carried out for 50K sheets using the image forming apparatus 100. Note that, toner used in the examples and a comparative example was produced with a method as follows.

<Toner>

Materials of 100 parts by weight of a binder resin (a polyester resin obtained through polycondensation of monomers of bisphenol A propylene oxide, terephthalic acid, and trimellitic anhydride: a glass transition temperature of 60° C., a softening temperature of 130° C.), 6 parts by weight of carbon black (manufactured by Mitsubishi Chemical Corporation: MA-100), 2 parts by weight of a charge control agent (manufactured by Japan Carlit Co., Ltd.: LR-147), and 2 parts by weight of polypropylene wax (manufactured by Sanyo Chemical Industries, Ltd.: Viscol 550P) were mixed in an air flow mixer (manufactured by Mitsui Mining Co., Ltd.: Henshell mixer) for ten minutes. The resulting mixture was melt-kneaded using a kneading and dispersing apparatus (manufactured by Mitsui Mining Co., Ltd.: Kneadics MOS140-800), the obtained kneading product was cooled, and then was roughly pulverized in a cutting mill. The roughly pulverized matter was finely pulverized using a fine pulverizer (manufactured by Mitsui Mining Co., Ltd.: CGS) and then classified using an air classifier (manufactured by Hosokawa Micron Corporation: TSP separator) to thereby prepare pigmented resin particles having a volume-average particle size of 6.5 μm and a BET specific surface area of 1.8 $m^2/g$. Note that, the volume-average particle size was measured using Coulter Multisizer II (manufactured by Beckman Coulter, Inc.,).

100 parts by weight of the pigmented resin particles and 2 parts by weight of hydrophobic silica fine particles (R8200 manufactured by AEROSIL, having a number-average particle size of 12 nm) that have been subjected to a hydrophobic treatment with hexamethyl disilazane were charged in an air flow mixer (manufactured by Mitsui Mining Co., Ltd.: Henshell mixer), where a tip speed of a stirring blade was set at 15 m/sec, and was mixed for two minutes.

<Carrier>

Carrier used in examples and the comparative example was prepared by a method as follows. First, a ferrite material was mixed in a ball mill and then calcined at 900° C. in a rotary kiln, and therafter the obtained calcined powder was finely pulverized so as to have an average particle size of not more than 2 μm by a wet pulverizing system using a steel ball as a pulverizing medium. The resulting ferrite fine powder was granulated by spray drying and the granulation material was baked at 1300° C. After baking, it was cracked using a crasher to obtain core particles composed of ferrite component having a volume-average particle size of 50 μm and a volume resistivity of $1\times10^9$ Ω·cm.

Next, as a coating liquid for coating the core particles, a silicone resin (trade name: TSR115, manufactured by Shin-Etsu Chemical Co., Ltd.) was dissolved and dispersed into toluene and a coaling liquid was then prepared. Using a spray coating apparatus, 5 parts by weight of the coating liquid was sprayed on 100 parts by weight of the core particles (equivalent of a silicone resin) to coat the core particles. The toluene was completely removed by evaporation and carrier that has a volume average particle diameter of 50 μm, a thickness of a silicone resin of 1 μm, and saturation magnetization of 65 emu/g.

<Two-Component Developer>

Two-component developer was prepared by mixing toner and carrier. The mixing method was such that 6 parts by weight of toner and 94 parts by weight of carrier were charged in a nauta mixer (trade name: VL-0, manufactured by Hosokawa Micron Corporation) and stirred and mixed for 20 minutes, thus preparing the two-component developer.

<Image Evaluation>

300 g of the prepared toner that has been kept under environment conditions of 25° C. and 65% for a week, was charged in the toner supply container 10 whose capacity is one liter, and after the toner supply container 10 was mounted on the image forming apparatus 100, an air blowing process was performed at 5 liters/min to carry out a consecutive print test for 50K sheets. Development conditions for the image forming apparatus 100 was such that a circumferential speed of the photoreceptor drum is 200 mm/sec, a circumferential speed of the developing roller is 280 mm/sec, a gap between the photoreceptor drum and the developing roller is 0.42 mm, and a gap between the developing roller and a regulation blade is 0.5 mm, and as conditions that the deposition amount of the toner on a paper in a solid image (a concentration of 100%) is 0.5 $mg/cm^2$ and the deposition amount of the toner on a non-image part becomes the smallest, each of surface potential of the photoreceptor drum and a development bias was adjusted. As a print test paper, an A4-sized electrophotography paper (Multireceiver: manufactured by Sharp Document System) was used, and as an image to be printed, a text image whose coverage of a print image to be recorded on the paper is 6% was printed.

In the consecutive print test for 50K sheets, no black streak was caused in all images on the 50K sheets. When the discharging electrode of the corona charger (the saw-toothed charger) after the test for 50K sheets was observed, no substance adhered to a tip portion 32*a* of the saw-toothed electrode 32 (refer to FIG. 7).

Comparative Example

A consecutive print test for 50K sheets was carried out, using an image forming apparatus having the same configuration as that of the image forming apparatus 100 except for that the image forming apparatus does not have the air blowing mechanism and the exhaust mechanism in a same way as that of the above examples except for that the air blowing process is not performed for the toner supply container, and as a result, black streaks are caused in all images on the 50K sheets. When the discharging electrode of the corona charger (the saw-toothed charger) after the test for 50K sheets was observed, adhesion of foreign matters 32*b* to a tip portion 32*a* of the saw-toothed electrode 32 was confirmed (refer to FIG. 8). Note that, when the foreign matters 32*b* adhering to the tip portion 32*a* was analyzed by a SEM-EDX (Scanning Electron Microscopy-Energy Dispersive X-ray Spectroscopy), Si element and O element were detected by definite peaks.

What is claimed is:

1. An image forming apparatus, comprising:

a toner supply container that is detachably disposed, including an air inlet for taking air inside from outside and an exhaust outlet for discharging internal air to outside;

an air blowing mechanism that sends air into the air inlet, wherein the air blowing mechanism includes an air blowing fan for drawing outside air in, an air blowing tube for leading air from the air blowing fan to the air inlet, and a coupling member for coupling the air blowing tube to the air inlet, wherein the air inlet coupling member includes a skirt for sealing in the vicinity of the air inlet in the toner supply container, and wherein the skirt has elasticity; and an exhaust mechanism for discharging air from the exhaust outlet.

2. The image forming apparatus according to claim 1, wherein the exhaust outlet has a filter which does not allow passage of toner.

3. The image forming apparatus according to claim 1, wherein the air inlet has an air valve for suppressing outflow of toner from inside the toner supply container through the air inlet to outside of the toner supply container or a filter which does not allow passage of toner outward through the air inlet.

4. The image forming apparatus according to claim 1, wherein the exhaust mechanism includes an air cleaning filter for cleaning air discharged from the exhaust outlet, an exhaust tube for leading exhaust air to outside, and an exhaust outlet coupling member for coupling the exhaust outlet and the exhaust tube.

5. The image forming apparatus according to claim 4, wherein the air cleaning filter is an activated carbon filter.

6. The image forming apparatus according to claim 4, wherein the exhaust outlet coupling member includes a skirt for sealing in the vicinity of the exhaust outlet in the toner supply container, and the skirt has elasticity.

7. The image forming apparatus according to claim 1, wherein the air blowing mechanism includes a humidity removing filter for removing humidity from the outside air before the air is delivered through the air inlet into the toner supply container.

8. The image forming apparatus according to claim 7, wherein the humidity removing filter contains silica gel or calcium chloride.

9. An image forming apparatus, comprising:

a toner supply container that is detachably disposed, including an air inlet for taking air inside from outside and an exhaust outlet for discharging internal air to outside;

an air blowing mechanism that sends air into the air inlet; and an exhaust mechanism for discharging air from the exhaust outlet, wherein the exhaust mechanism includes an air cleaning filter for cleaning air discharged from the exhaust outlet, an exhaust tube for leading exhaust air to outside, and an exhaust outlet coupling member for coupling the exhaust outlet and the exhaust tube, wherein the exhaust outlet coupling member includes a skirt for sealing in the vicinity of the exhaust outlet in the toner supply container, and the skirt has elasticity.

10. An image forming apparatus, comprising:

a toner supply container that is detachably disposed, including an air inlet for taking air inside from outside and an exhaust outlet for discharging internal air to outside;

an air blowing mechanism that sends air into the air inlet wherein the air blowing mechanism includes a humidity removing filter for removing humidity from the outside air before the air is delivered through the air inlet into the toner supply container; and an exhaust mechanism for discharging air from the exhaust outlet.

11. The image forming apparatus according to claim 10, wherein the humidity removing filter contains silica gel or calcium chloride.

* * * * *